United States Patent [19]

Martha, Jr.

[11] Patent Number: 4,545,497

[45] Date of Patent: Oct. 8, 1985

[54] CONTAINER CAP WITH FRANGIBLE SEPTUM

[75] Inventor: Eugene F. Martha, Jr., North Attleboro, Mass.

[73] Assignee: Millipore Corporation, Bedford, Mass.

[21] Appl. No.: 672,309

[22] Filed: Nov. 16, 1984

[51] Int. Cl.[4] ..... B65D 39/04

[52] U.S. Cl. ..... 215/253

[58] Field of Search ..... 215/247, DIG. 3, 253; 604/415

[56] References Cited

U.S. PATENT DOCUMENTS

| | | | |
|---|---|---|---|
| 1,180,665 | 4/1916 | McElroy | 215/247 |
| 1,413,703 | 4/1922 | Biehn | 215/247 |
| 2,783,909 | 3/1957 | Roberts | 215/247 |
| 2,848,130 | 8/1958 | Jesnig | 215/247 X |
| 4,293,078 | 10/1981 | Percarpio et al. | 215/247 |
| 4,295,572 | 10/1981 | Percarpio | 215/247 |
| 4,307,766 | 12/1981 | Tanokura | 215/247 X |

*Primary Examiner*—Donald F. Norton

*Attorney, Agent, or Firm*—Andrew T. Karnakis

[57] ABSTRACT

A disposable, one-piece cap for a liquid container includes a frangible septum which allows easy penetration by a syringe needle to permit withdrawal of the liquid. The septum includes a plurality of grooves which are thinner than the thickness of the remainder of the septum to facilitate tearing of the septum as the needle penetrates. Such tearing prevents a seal from forming around the needle and thus allows air to enter the container avoiding problems associated with the formation of a partial vacuum within the container as the sample is withdrawn.

5 Claims, 4 Drawing Figures

CONTAINER CAP WITH FRANGIBLE SEPTUM

FIELD OF THE INVENTION

This invention relates generally to caps that are used to stopper containers, and more particularly to such caps that include a piercable septum that permits the contents of the container to be withdrawn by a syringe needle without removing the cap from the container. Caps of this type have particular utility in the automatic processing of liquid samples as is used, for example, in liquid chromatography (LC).

BACKGROUND OF THE INVENTION

Caps used with liquid containers in which withdrawal of the contents is to be achieved without removing the cap have been known for many years. Often such caps are used in medical or analytical scientific applications where a reliably sealed container, that also affords ready access to its liquid contents, is required.

One such example is shown in U.S. Pat. No. 1,180,665 which discloses a cap having a solid, cylindrically-shaped body made of resilient material with a shoulder which abuts the rim of the container opening. Since the opening is slightly smaller than the dimensions of the body of the cap, a tight seal is formed when the cap is inserted. The cap includes a longitudinal hole which is compressed closed when the cap is inserted into the container opening. To remove the liquid contents, a syringe needle is used to penetrate the cap through the hole. Due to the resilient nature of the cap material, a seal will form around the needle as it penetrates the cap. When withdrawing the liquid contents from this capped container, the needle must be lined up exactly with the hole in the cap, and secondly, a partial vacuum will be formed within the container as liquid is withdrawn into the needle.

Problems of the type described above become magnified when the stoppered containers are used for LC analysis, especially in an automatic sample withdrawal system. In LC analysis, accurate mixtures of liquid samples are stored in stoppered containers for subsequent injection into the chromatographic instrument. Generally the containers are placed side by side on an automated carousel which positions the sealed container under an automated syringe needle which withdraws the appropriate amount of sample for subsequent processing. The need for precison positioning of the needle involves costly equipment and adds complexity to the instrument design. The partial vacuum produced as liquid is withdrawn from the sealed container may cause more of one component of the precise mixture to evaporate than another due to the highly volatile nature of the liquids typically used, thereby changing the composition and producing an error in the LC analysis. Moreover, since the partial vacuum forms in the space above the liquid as liquid is withdrawn, a portion of the sample in the needle could be drawn back into the container as the needle opening traverses the vacuum space thereby altering the intended volume to be withdrawn and producing resultant analysis errors.

Another cap is shown in U.S. Pat. No. 1,413,703. This cap is a two-piece, crimp-on type, with one piece being a resilient septum that fits over the container opening and the other piece fitting over the septum and around the rim of the container. The two pieces are crimped together to securely seal the container opening. The septum is designed to be piercled by a needle for withdrawing the contents of the container; however, as was the case with the afore-mentioned patent, a seal is formed around the needle as it penetrates the septum resulting in composition and volume errors previously mentioned with respect to the creation of a partial vacuum within the container. Furthermore, the two-piece construction is burdensome for it requires special crimping tools to create a sealed closure and this cap is not easily removed once crimped to the container. Also the lateral dimensions of the cap exceed that of the container thereby limiting the number of containers which can be packed side-by-side as in an automated carousel.

A wide variety of other special purpose caps exists in the patent art as exemplified by U.S. Pat. Nos. 3,901,402 and 4,193,402. However, the caps disclosed in these patents do not overcome the difficulties associated with partial vacuums when a needle is inserted to withdraw the contents of the container because in each instance a seal is maintained around the needle as liquid is being withdrawn.

Thus it is apparent the need still exists for an inexpensive, easily manufactured cap that is readily insertable into and removable from a container and that has a large area septum for piercing with a needle that will not cause a partial vacuum during withdrawal of liquid by the needle and that is adaptable for use in LC analysis without contributing unacceptable errors.

SUMMARY OF THE INVENTION

The present invention overcomes the limitations of prior art caps by providing a one-piece, disposable cap having a frangible septum which is easily pierced by a needle and which also tears as the needle penetrates. This ensures a venting action which allows air to enter the container as liquid volume is extracted thereby avoiding the creation of a partial vacuum. In accordance with a preferred embodiment of the invention, the upper portion of the cap includes a convex septum that encompasses essentially the entire area of the opening of the container providing a large target area for the needle when used with automatic injection equipment. The septum includes a series of grooves whose thickness is less than the remainder of the septum. This non-uniform cross-section of the septum creates unbalanced forces when a needle pierces the septum causing the septum to tear along these grooves and allowing air to enter the container. This ensures that a partial vacuum will not occur in the container when its contents are withdrawn by the needle. That part of the upper portion which remains external to the container forms a convenient means for manual or mechanical grasping and subsequent insertion into and removal from the container. The lower portion of the stopper is inserted into the container opening to form an interference fit therewith. The cap also includes both a shoulder and an annular flange which respectively abut the rim and the inner surface of the container to form a reliable seal.

DESCRIPTION OF THE PREFERRED EMBODIMENT

Figure 1:
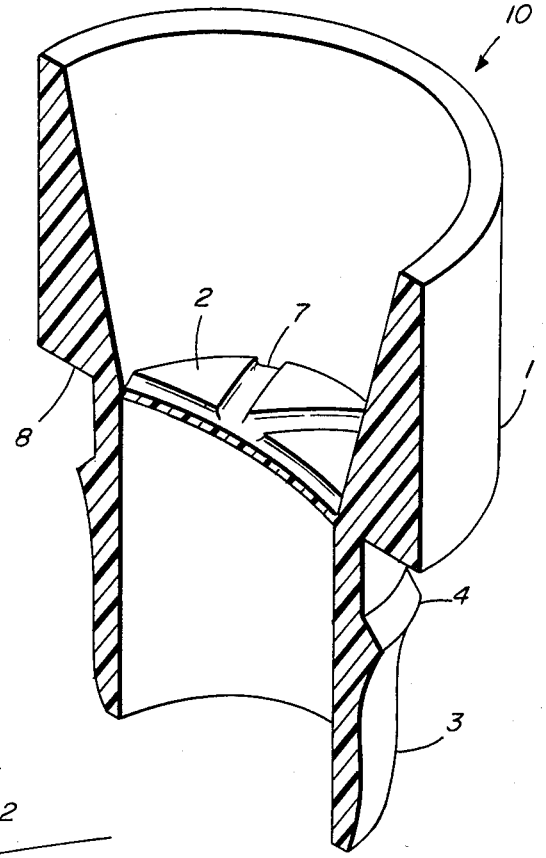
FIG. 1 is a perspective, cross-sectional view of a cap embodying the features of the invention.

FIG. 1 shows in perspective, a disposable cap 10 for a liquid container that is formed with a resilient plastic material such as polyethylene that may be suitably deformed to allow insertion into and removal from a container 12 while still maintaining a reliable seal. Stoppered containers of this type are commonly used with an automatic sample injection system of an LC instrument.

Figure 2:
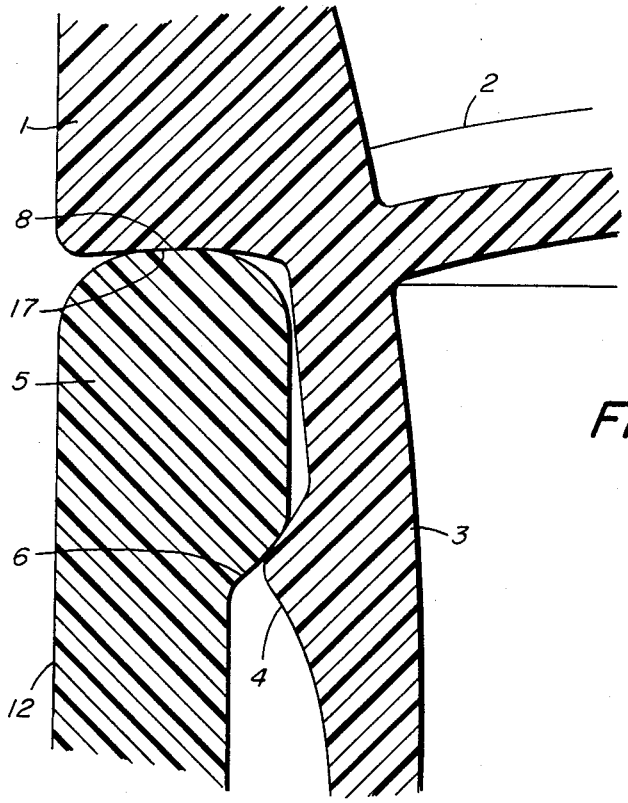
FIG. 2 is a cross-sectional view of the cap mating with the rim of a container.

Referring also to FIG. 2, the cap 10 is of one-piece construction and includes an upper portion 1 which, after insertion of the cap, remains outside the container 12 as well as a lower portion 3 which is removably inserted into the container. When the cap is fully inserted into the container, a shoulder 8 of the upper portion sealingly contacts the top rim 17 of the container due to the resiliency of the cap material to form an air-tight seal. An annular flange 4 extends circumferentially about the periphery of the lower portion of the cap to sealably contact the inner surface 6 of the container. The container 12 illustrated in FIG. 2 includes an enlarged annular lip 5, the bottom portion of which engages the flange 4. The lower portion of the cap deforms as it slides over the lip to provide additional sealing. Thus two seals are formed, one between the shoulder 8 of the cap 10 and the rim 17 of the container 12, and the other between the flange 4 and the bottom of the lip 5. It is apparent that the dual seal principle disclosed applies equally as well to containers not having a lip.

As also shown in FIG. 2, the outer diameter of the upper portion 1 of the cap 10 is the same as the outer diameter of the container 12. Thus when stoppered containers of the present invention are aligned side by side, the packing density is only limited by the outer diameter of the container. LC applications often require the injection of many different samples from individual containers positioned on a revolving carousel during chromatographic analysis in automated sequence and having a reduced packing density allows more samples to be stored in a given area.

Figure 3:
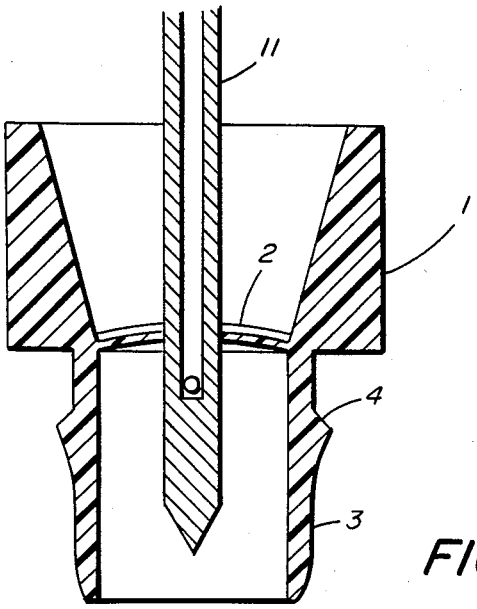
FIG. 3 is a sectional view of the cap with a syringe needle piercing the septum of the cap.
Figure 4:
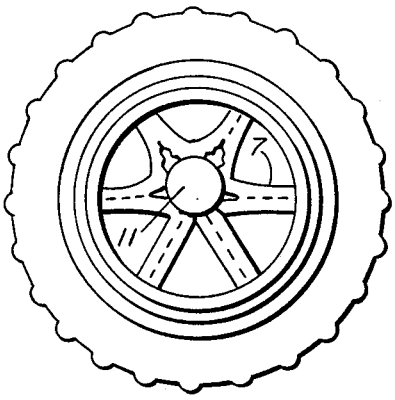
FIG. 4 is a plan view of the cap of FIG. 3 showing the needle tearing the septum.

Referring again to FIG. 1, the upper portion 1 of the cap 10 is of generally tubular construction with a closed bottom that forms a piercable septum 2 which encompasses the entire inner diameter of the upper portion. Included as part of the septum are six grooves 7 which radiate from the center of the septum like the spokes of a wheel offset by 60° from one another (see also FIG. 4). The geometric pattern of the grooves is such that a needle 11 of 0.060 inch diameter will always intersect one of the grooves as the needle is inserted into the septum. These grooves are characterized in that their thickness is significantly less than the remainder of the septum 2 as shown in the cross-sectional view of FIG. 1. The septum is formed with a spherical radius that is slightly convex relative to the opening of the container 12. The combination of the grooves and the convex shape of the septum enhance the frangibility of the septum when pierced by a needle by creating weakened areas to induce material failure resulting from the unbalance of forces across the septum as the needle penetrates that force the septum to tear along these grooves. It has also been found advantageous to choose a material having low elongation to minimize material stretching and thus aid in this tearing action. The preferred cap material is polyethylene. This tearing insures a venting action which allows air to enter the container as liquid volume is extracted thereby equalizing the pressure inside and outside of the container and assuring that no partial vacuum is formed in the container as sample is withdrawn. FIGS. 3 and 4 illustrate the needle action and subsequent tearing of the septum as the needle penetrates the septum 2. As shown in FIG. 4, the multiplicity of grooves are geometrically arranged to provide a large area for the desired tearing to occur to alleviate the need for the needle to precisely enter the center of the septum.

Although the invention has been described with respect to a particular embodiment, this is solely for purposes of illustration as modifications and changes will become apparent to those of skill in the art. Therefore, the invention is to be considered as being defined by the accompanying claims.

I claim:

1. A one-piece cap formed of a resilient material and adapted to be inserted into a container adapted to hold a liquid sample comprising:

an upper part and a lower part, said upper part remaining externally positioned from the interior of said container when said cap is inserted therein, said lower part adapted to be matingly and removably inserted into the interior of said container;

the lower surface of said upper part extending radially from said lower part to form a shoulder for sealingly contacting the rim of said container;

said upper part including means defining a septum suitable for piercing by a needle, said septum having areas of reduced thickness forming grooves therein such that said septum will separate laterally from said needle when pierced by said needle creating a space around said needle sufficiently greater than the diameter of said needle to allow air to enter said container as said liquid sample is withdrawn by said needle whereby no partial vacuum is formed in said container during withdrawal of said sample.

2. A cap as in claim 1 further comprising an annular flange surrounding said lower part at a position remote from said lower surface of said upper part.

3. A cap as in claim 1 wherein said upper part is generally tubular and protrudes above said lower part and includes a closed surface adjacent said lower part defining said septum and said septum being formed with a spherical radius that is convex relative to said lower part.

4. A cap as in claim 3 further comprising an annular flange surrounding said lower part at a position remote from said lower surface of said upper part.

5. A cap as in claim 3 wherein the outer diameter of said tubular upper part is equal to the outer diameter of said container.

* * * * *